United States Patent [19]

Wernicke et al.

[11] Patent Number: 4,997,749

[45] Date of Patent: Mar. 5, 1991

[54] OVERFLOW-FREE COLOR PHOTOGRAPHIC DEVELOPMENT SYSTEM

[75] Inventors: Ubbo Wernicke, Cologne; Herbert Mitzinger, Lindlar-Remshagen, both of Fed. Rep. of Germany

[73] Assignee: Agfa-Gevaert Aktiengessellschaft, Leverkusen, Fed. Rep. of Germany

[21] Appl. No.: 290,351

[22] Filed: Dec. 27, 1988

[30] Foreign Application Priority Data

Jan. 9, 1988 [DE] Fed. Rep. of Germany ..... 3800385

[51] Int. Cl.[5] ..... G03C 5/30

[52] U.S. Cl. ..... 430/464; 430/399; 430/434; 430/436; 430/467; 430/468; 430/484

[58] Field of Search ..... 430/399, 434, 436, 464, 430/484, 467, 468

[56] References Cited

U.S. PATENT DOCUMENTS

| | | | |
|---|---|---|---|
| 3,986,877 | 10/1976 | Timmerman et al. | 430/467 |
| 4,161,406 | 7/1979 | Bulloch | 430/436 |
| 4,756,997 | 7/1988 | Marchesano | 430/464 |

FOREIGN PATENT DOCUMENTS 173203 3/1986 European Pat. Off. .

OTHER PUBLICATIONS

Processing Kodak Ektacolor Plus and Professional Papers, Eastman Kodak Company, 1985.

*Primary Examiner*—Hoa Van Le

*Attorney, Agent, or Firm*—Connolly & Hutz

[57] ABSTRACT

True-to-type development without any overflow is achieved with a developer solution system of a refill solution and—replenished therewith—a ready-to-use developer solution which contains the following constituents in the quantities indicated per liter aqueous solution and, optionally, other typical consituents:

3–15 g of the following color developer compound

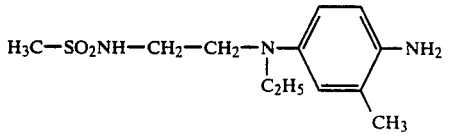

or a corresponding quantity of salts thereof,

8–35 g $PO_4^3$ ions, at least 0.2 g antioxidant and 2.1–4.2 g KBr and which is adjusted to a pH value of 10.5 to 12.5, the regeneration quota amounting to between 50 and 120 ml/m$^2$ developed material and the refill solution containing the individual constituents in a such a concentration that, for the above-mentioned regeneration quota, the in-use developer solution always contains the constituents shown above in the quantities indicated.

2 Claims, No Drawings

OVERFLOW-FREE COLOR PHOTOGRAPHIC DEVELOPMENT SYSTEM

This invention relates to an overflow-free color photographic developer solution system consisting of a refill solution and a ready-to-use color photographic developer solution replenished therewith.

EP-A-173 203 describes a process in which the development of an exposed silver halide recording material is carried out with a color developer solution to which refill solution for replenishing the spent chemicals is only added in such a quantity that no overflow is formed. This process has the advantage over all known processes with overflow that there is no need for disposal of the overflow which cannot be introduced into the wastewater on ecological grounds.

The disadvantage of the process according to EP-A-173 203 is that the photographic recording material to be developed must contain silver chloride in a quantity of at least 40 mol-%, more especially at least 70 mol-% chloride. However, chloride-rich silver halides tend to be unstable. For this reason, photographic recording materials for the production of colored images mostly have photosensitive emulsion layers containing silver halide crystals of which the chloride content is less than 40 mol-% and, more especially, less than 30 mol-%.

The object of the present invention was to provide, even for color photographic negative papers with low chloride content, a developer solution system in which there is no longer any overflow.

According to the invention, this object is achieved by a developer solution system consisting of a refill solution and a ready-to-use developer solution replenished therewith, in which both solutions contain developer solution constituents known per se in certain concentrations.

Accordingly, the present invention relates to a developer solution system consisting of a refill solution and a ready-to-use developer solution replenished therewith, characterized in that the ready-to-use developer solution contains the following constituents in the quantities indicated per liter aqueous solution and, optionally, other typical constituents:

0–20 g benzyl alcohol,

3–15 g of the following color developer compound

CD 3

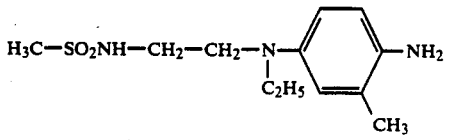

or a corresponding quantity of salts thereof,

0–2 g of the following color developer compound

CD 4

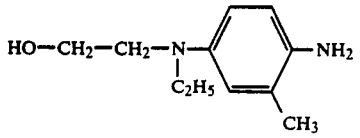

or a corresponding quantity of salts thereof,

8–35 g $PO_4^3$ ions, at least 0.2 g antioxidant and 2.1–4.2 g KBr and which is adjusted to a pH value of from 10.5 to 12.5, in that the regeneration quota amounts to between 50 and 120 ml/m$^2$ and preferably to between 60 and 100 ml/m$^2$ developed material and the refill solution contains the individual constituents in a such a concentration that, for the regeneration quota mentioned, the in-use developer solution always contains the above-mentioned constituents in the quantities indicated.

The other constituents may be other developer substances, optical brighteners, lubricants (for example polyalkylene glycols), surfactants, sodium and potassium sulfite, anti-lime agents, stabilizers and agents for adjusting the desired pH value.

Suitable antioxidants, which are preferably used in a quantity of 0.2 to 4 g, are for example hydroxylamine, diethyl hydroxylamine and sulfites.

The developer substance or developer substances is/are preferably used in a quantity (based on free base) such that the ratio by weight of developer substance to KBr is $<4$ and more especially in the range from 1.5 to 3.5.

The developer substances used are, in particular, only CD 3 and optionally CD 4.

The EP2 development process extensively used worldwide is carried out at 33° C. and takes 210 seconds. A considerable overflow of around 250 ml/m$^2$ developed paper is formed.

With the development system according to the invention, not only is the overflow completely avoided, lower development temperatures or shorter development times compared with EP2 may be adjusted as required.

COMPARISON EXAMPLE

A commercially available color paper (Agfacolor 8) was exposed imagewise, bleached, fixed, washed and dried. Processing was adapted to type in regard to minimal densities, $\gamma$-1-values, $\gamma$-2-values and maximal densities.

The aqueous developer contained the following substances per liter:

15 ml benzyl alcohol 8.5 ml diethylene glycol 3.0 g hydroxylamine sulfate 5.5 CD 3

2.0 g $K_2SO_3$ 34 g $K_2CO_3$ and 0.6 g KBr and also surfactants, optical brighteners, stabilizers and anti-lime agents in the usual quantities, and is adjusted with KOH to pH 10.2.

The developer was regenerated with 325 ml/m$^2$ developed paper of a refill solution of which the composition had been adjusted so that the aqueous developer always contained the substances shown in the quantities indicated, producing an overflow of approximately 250 ml/m$^2$ developed paper.

The development time was 210 seconds and the development temperature 33° C.

EXAMPLE

The Comparison Example was repeated with the differences that the $K_2CO_3$ was replaced by an equimolar quantity of tripotassium phosphate, the quantity of CD 3 was doubled and the quantity of KBr was increased to 3.0 g. The pH value was adjusted to 11.7.

The developer was regenerated with 80 ml/m² developed paper of a refill solution having the composition shown below; no overflow was formed.

The development time was 210 seconds at a development temperature of 27° C.

The following maximal densities were obtained:

| | Yellow | Magenta | Cyan |
|---|---|---|---|
| Comparison Example | 2.40 | 2.50 | 2.60 |
| Example | 2.45 | 2.80 | 2.50 |

When the development temperature was increased, the following development times were achieved for substantially the same maximal densities:

| | |
|---|---|
| 33° C./120 seconds<br>36° C./ 80 seconds<br>41° C./ 45 seconds | |
| Refill solution | |
| 775 ml water | |
| 75 ml part A | |
| 75 ml part B | |
| 75 ml part C | |
| Part A contained per liter: | |
| Benzyl alcohol | 320.0 ml |
| Ethylene glycol | 320.0 ml |
| Polyethylene glycol, MW 400 | 320.0 ml |
| Diethyl hydroxylamine, 85% by weight aqueous solution | 33.3 ml |
| and surfactants and optical brighteners in the usual quantities; pH value 9.5. | |
| Part B contained per liter: | |
| KOH | 390.0 g |
| Monopotassium phosphate | 346.7 g |
| Potassium sulfite | 21.5 g |
| and anti-lime agents in the usual quantity; pH value 14. | |
| Part C contained per liter: | |
| CD 3 | 213.3 g |
| Potassium sulfite | 13.0 g |
| KOH | 17.3 g |
| pH value 2.0 | |

We claim:

1. A negative working developer solution system consisting essentially of a refill solution and a ready-to-use developer solution replenished therewith for color negative paper, wherein said ready-to-use developer solution contains the following constituents in the quantities indicated per liter aqueous solution 0–20 g benzyl alcohol 3–15 g of the following color developer compound

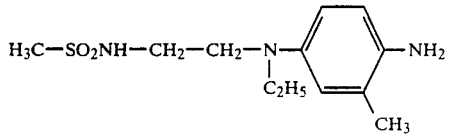

or a corresponding quantity of salts thereof,

0–2 g of the following color developer compound

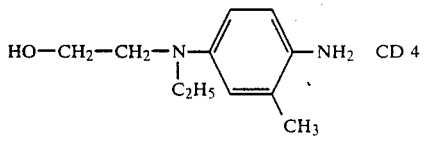

CD 4 or a corresponding quantity of salts thereof,

8–35 g $PO_4^3$ ions, at least 0.2 g antioxidant and 2.1–4.2 g KBr and is adjusted to a pH value of from 10.5 to 12.5, in that the regeneration quota amounts to between 50 and 120 ml/m² developed material and the refill solution contains the individual constituents in such a concentration that, for the regeneration quota shown, the in-use developer solution always contains the above-mentioned constituents in the quantities indicated.

2. A developer solution system as claimed in claim 1, characterized in that the ratio by weight of developer substances (based on free base) to KBr is $<4$.

* * * * *